US011175000B2

(12) United States Patent
Van Bommel et al.

(10) Patent No.: US 11,175,000 B2
(45) Date of Patent: Nov. 16, 2021

(54) LIGHTING DEVICE WITH A WIRELESS COMMUNICATION ANTENNA

(71) Applicant: SIGNIFY HOLDING B.V., Eindhoven (NL)

(72) Inventors: Ties Van Bommel, Eindhoven (NL); Antonius Adrianus Maria Marinus, Eindhoven (NL); Yacouba Louh, Eindhoven (NL); Frank Jan Baas, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/246,159

(22) Filed: Aug. 24, 2016

(65) Prior Publication Data

US 2017/0059095 A1 Mar. 2, 2017

(30) Foreign Application Priority Data

Sep. 1, 2015 (EP) ..... 15183300

(51) Int. Cl.

| | |
|---|---|
| ***F21K 9/232*** | (2016.01) |
| ***H05B 47/19*** | (2020.01) |
| ***F21K 9/90*** | (2016.01) |
| ***F21V 23/04*** | (2006.01) |
| *F21Y 101/00* | (2016.01) |

(52) U.S. Cl.

CPC ..... *F21K 9/90* (2013.01); *F21K 9/232* (2016.08); *F21V 23/0435* (2013.01); *H05B 47/19* (2020.01); *F21Y 2101/00* (2013.01)

(58) Field of Classification Search

CPC ... F21K 9/232; F21K 9/90; F21K 9/23; F21K 9/238; F21K 9/135; F21K 9/233; F21K 9/235; F21K 9/237; F21K 9/27; F21K 9/64; F21K 9/66; F21K 99/00; F21Y 2101/00; F21V 23/045; H05B 47/19

USPC ..... 315/34

See application file for complete search history.

(56) References Cited

U.S. PATENT DOCUMENTS

| | | | | |
|---|---|---|---|---|
| 8,633,646 | B2 | 1/2014 | Molezion | |
| 2006/0126338 | A1* | 6/2006 | Mighetto | F21V 29/677 362/294 |
| 2007/0069833 | A1* | 3/2007 | Serban | H01P 1/2007 333/34 |
| 2010/0289407 | A1* | 11/2010 | Anderson | F21V 29/506 315/35 |
| 2012/0293981 | A1 | 11/2012 | Motoya et al. | |
| 2013/0058080 | A1* | 3/2013 | Ge | F21V 19/005 362/231 |
| 2013/0136454 | A1 | 5/2013 | Yu | |
| 2014/0355246 | A1* | 12/2014 | Yotsumoto | F21K 9/237 362/86 |

FOREIGN PATENT DOCUMENTS

| | | |
|---|---|---|
| CN | 103307464 A | 9/2013 |
| CN | 103499037 A | 1/2014 |
| CN | 103542308 A | 1/2014 |

(Continued)

*Primary Examiner* — Alexander H Taningco
*Assistant Examiner* — Amy X Yang

(57) ABSTRACT

There is provided a lighting device comprising an exhaust tube and a wireless communication antenna arranged inside the exhaust tube. There is also provided a method for producing such a lighting device.

12 Claims, 5 Drawing Sheets

(56) References Cited

FOREIGN PATENT DOCUMENTS

| | | | | |
|---|---|---|---|---|
| CN | 203442567 | U | 2/2014 | |
| CN | 204153513 | U | 2/2015 | |
| CN | 204328550 | U | 5/2015 | |
| EP | 2730833 | A1 | 5/2014 | |
| EP | 2803900 | A1 | 11/2014 | |
| JP | 2012038704 | A | 2/2012 | |
| JP | 5065545 | B1 | 11/2012 | |
| JP | WO 2013014821 | A1 * | 1/2013 | ..... F21V 29/004 |
| JP | 2013140776 | A | 7/2013 | |
| JP | 2013533581 | A | 8/2013 | |
| JP | WO2013014821 | A1 | 2/2015 | |
| JP | 2015522205 | A | 8/2015 | |
| WO | WO199420973 | A1 | 9/1994 | |
| WO | WO2006063212 | A2 | 6/2006 | |
| WO | 2006063212 | A8 | 8/2008 | |
| WO | WO2013014821 | A1 | 1/2013 | |
| WO | WO-2013014821 | A1 * | 1/2013 | ..... F21K 9/23 |

* cited by examiner

LIGHTING DEVICE WITH A WIRELESS COMMUNICATION ANTENNA

TECHNICAL FIELD

The present invention relates to a lighting device which typically is based on solid state lighting (SSL) technology and which has a wireless communication antenna. The present invention also relates to a method for producing such a lighting device.

BACKGROUND

Lighting devices based on SSL technology which have an antenna for wireless control of the solid state light sources are known in the art. The intensity and color of the emitted light may for example be controlled in this way. A lighting device of this type is disclosed in WO 2013014821 A1. That lighting device has an antenna that may be arranged inside or around a support member for a semiconductor light emitting element.

It is desirable to find ways to incorporate antennas into the designs of existing lighting devices without significant modifications so that the addition of unnecessary costs and complexity to the production process is avoided. A complicating factor here is the fact that the technical performance of the antenna is affected by its position inside the lighting device.

SUMMARY

The objective of the present invention is to provide an improved or alternative lighting device having a wireless communication antenna.

According to a first aspect, there is provided a lighting device comprising an exhaust tube and a wireless communication antenna arranged inside the exhaust tube.

By "exhaust tube" is meant a tube through which a gas may be introduced into the lighting device during production and which is later sealed. Exhaust tubes are often found in general lighting service (GLS) bulbs, i.e. conventional incandescent light bulbs. During the production of such light bulbs, the exhaust tube allows for air to be exhausted from the bulb and an inert gas to be pumped into the bulb. Modern lighting devices based on SSL technology may also have an exhaust tube for introducing a gas into the envelope that encloses the solid state light sources. The gas may improve the heat transfer from the solid state light sources as well as the lifetime of the lighting device by reducing lumen depreciation of the solid state light sources. The exhaust tube is electrically isolating and may for example be made of glass.

By the antenna being arranged "inside" the exhaust tube is meant that at least a portion of the antenna is inside an interior space formed by the exhaust tube. The antenna may have another portion that is arranged outside the exhaust tube.

By placing the antenna inside the exhaust tube, the antenna is well supported mechanically so the risk of the antenna displacing because of rough handling by the end user is reduced. This is important since the antenna needs to be positioned properly for it to operate optimally. Moreover, when the antenna has this position, it is easy to design the lighting device so that the antenna does not interfere with the optical path of the light emitted by the solid state light sources and also so that other parts, such as a heat sink or an electronics unit, are at such a distance from the antenna that the risk of reduced antenna performance caused by for example shielding is small. Furthermore, placing the antenna inside the exhaust tube is a simple step that adds little cost and complexity to the production process. For example, it may still be possible to use much of existing GLS production lines which have been optimized with respect to cost efficiency and speed over a long period of time.

According to one embodiment, an outer portion of the antenna protrudes from an open end of the exhaust tube. The antenna usually needs to have a specific length in order to be optimally sensitive to a signal of a specific frequency. The optimal antenna length may in some cases be longer than the exhaust tube, and a solution to this problem is to have the antenna stick out from the exhaust tube. The portion of the antenna that protrudes from the exhaust tube can be arranged in many different ways depending on, for example, the amount of the free space inside the lighting device.

According to one embodiment, the outer portion of the antenna extends straight along the exhaust tube.

According to one embodiment, the outer portion of the antenna is wound around the exhaust tube.

According to one embodiment, the lighting device further comprises a support structure supporting the outer portion of the antenna at a distance from the exhaust tube.

According to one embodiment, the lighting device further comprises a tubular light source carrier attached to the exhaust tube, the exhaust tube being arranged partly inside the tubular light source carrier. A tubular light source carrier promotes efficient heat transfer from the light sources by creating convection currents through the carrier. Differently stated, the tubular light source carrier may give rise to a thermal chimney effect. It should be noted that the carrier may also improve the receiving properties of the antenna, for example the bandwidth. More specifically, if the antenna is a straight monopole antenna, the carrier may be used to increase the capacitive coupling between an end tip of the antenna to the ground plane acting as the counterpole and thereby to increase the current at the end tip. Differently stated, the carrier may be used to increase the parasitic capacitance between the end tip of the antenna and the ground.

According to one embodiment, an open end of the exhaust tube is situated inside the tubular light source carrier.

According to one embodiment, the exhaust tube extends throughout the entire tubular light source carrier so that an open end of the exhaust tube is outside the tubular light source carrier.

According to one embodiment, the tubular light source carrier is adapted to act as a radiator, the electrical resonance frequency of the tubular light source carrier being approximately equal to a receiving frequency of the antenna. It should be noted that the received signal usually comprises a range of frequencies and that the resonance frequency of the tubular light source carrier in practice is a narrow range of frequencies. This narrow frequency range is usually centered with respect to, and much smaller than, the frequency range of the received signal. The narrow frequency range may for example be about 4% of the frequency range of the received signal. A carrier comprising a conductive material can be made to resonate at a frequency that the antenna is configured to receive. This may improve the antenna's reception of weak signals because the resonating carrier operates as a secondary radiator that enhances the received signal. For the resonance to occur, the carrier should be positioned in the near field region of the antenna and the dimensions of the carrier (its height, width and so forth)

should be such that the carrier has an electrical resonance frequency that matches the frequency of the received signal.

According to one embodiment, the lighting device further comprises: a connector for mechanically and electrically connecting the lighting device to a lamp socket; a light source carrier having one or more solid state light sources; a light transmissive envelope, the light source carrier and the exhaust tube being arranged inside the envelope; a driver configured to power the one or more solid state light sources; and a control circuit electrically connected to the antenna and configured to control the one or more solid state light sources. The light source carrier may for example be the tubular light source carrier mentioned above.

According to one embodiment, the control circuit is positioned completely inside the envelope, supported for example by the light source carrier. If the control circuit is positioned completely inside the envelope then the antenna may be positioned upside down relative to how it is positioned in the case where the control circuit is positioned inside the connector. This may facilitate the closing of the exhaust tube (because it can be closed where the antenna is not in the way) and may also facilitate electrically connecting the control circuit to the solid state light sources.

According to one embodiment, the lighting device further comprises a light scattering layer and/or a wavelength converting layer. Such layers may be arranged on the light transmissive envelope or on the solid state light sources, for instance. The scattering layer may improve the light distribution by making the intensity or color of the light more uniform. A wavelength converting layer may be used for altering the color of the light emitted by the solid state light sources. For example, a common technique to provide white light is to combine a non-white light source with a wavelength converter. The wavelength converter converts some of the light emitted by the light source to a wavelength such that the mix of converted and unconverted light appears white or almost white to the eye.

According to one embodiment, the lighting device is a gas filled light bulb.

According to a second aspect, there is provided a method for producing a lighting device, the method comprising arranging an antenna inside an exhaust tube of the lighting device. The features and effects of the second aspect are similar to those of the first aspect.

According to one embodiment, the method further comprises forming an airtight connection between the antenna and the exhaust tube.

It is noted that the invention relates to all possible combinations of features recited in the claims.

BRIEF DESCRIPTION OF THE DRAWINGS

The present invention will now be described in more detail with reference to the appended drawings in which.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
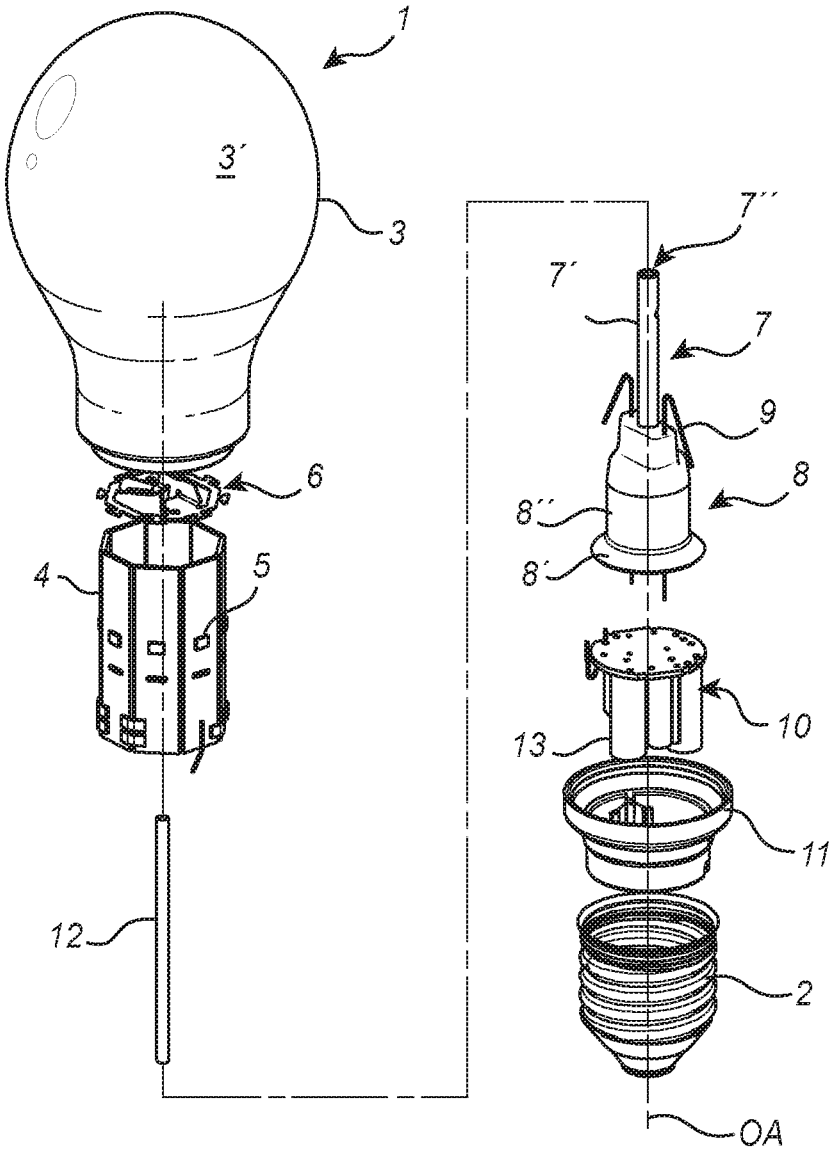
FIG. 1 shows a schematic exploded view of an example of a lighting device.

FIG. 1 shows an example of a lighting device 1 in the form of a light bulb, such as a retrofit A60 light bulb. The lighting device 1 has an optical axis OA which is a central axis of the lighting device 1. The lighting generated by the lighting device 1 is in this example substantially rotationally symmetric around the optical axis OA. A connector 2 is arranged at an end of the lighting device 1. The connector 2 is adapted to mechanically and electrically connect the lighting device 1 to a lamp socket. In the illustrated example, the connector 2 is a screw base, for example an E27 screw base, but the connector 2 may be of a different type, for example a bayonet light bulb mount. The connector 2 is typically made of a metal.

The lighting device 1 has a light transmissive envelope 3, the center of which is displaced along the optical axis OA relative to the connector 2. The envelope 3 can be made of glass or plastics, for instance. In the illustrated example, the envelope 3 has a pear-like shape formed by a round head portion and a circular cylindrical neck portion, the head portion and neck portion being distal and proximate to the connector 2, respectively. The envelope 3 is filled with a gas, for example helium or a mix of helium and oxygen. The lighting device 1 is thus a gas filled light bulb. There may be a surface layer 3' on the inside of the envelope 3. The surface layer 3' may be a light scattering layer or a wavelength converting layer. Examples of light scattering layers include coatings of $TiO_2$, $BaSO_4$, or $Al_2O_3$ scattering particles in a silicone polymer matrix. Examples of wavelength converting layers include coatings comprising one or more phosphors, such as YAG, LuAG and ECAS.

A tubular light source carrier 4 (henceforth referred to as the "carrier" for brevity) is centered on the optical axis OA inside the envelope 3. The carrier 4 in this example has an octagonal cross section perpendicular to the optical axis OA but other cross sections, shapes, such as hexagonal or circular cross sections, are possible. It should be noted that other embodiments of the lighting device 1 may have carriers that are not tubular. Several solid state light sources 5 (henceforth referred to as the "light sources" for brevity) are mounted on the carrier 4. The light sources 5 and the carrier 4 together form an L2 structure. The carrier 4 comprises a circuit board for electrically connecting the light sources 5, for example a printed circuit board. The carrier 4 is also adapted to be a heat sink for the light sources 5, allowing heat to be transferred efficiently from the light sources 5 to the surrounding gas inside the envelope 3. The light sources 5 may for example be semiconductor light emitting diodes, organic light emitting diodes, polymer light emitting diodes, or laser diodes. All of the light sources 5 may be configured to emit light of the same color, for example white light, or different light sources 5 may be configured to emit light of different colors.

A fastener 6, sometimes referred to as a "spider", inside the carrier 4 attaches the carrier 4 to an exhaust tube 7 of the lighting device 1. The fastener 6 may for example have protrusions that mate with holes in the carrier 4 and a locking feature that clamps to the exhaust tube 7. By this arrangement, the carrier 4 surrounds a portion of the exhaust tube 7 so that the exhaust tube 7 is partly arranged in the interior space of carrier 4. The exhaust tube 7 extends along the optical axis OA which coincides with the central axis of the carrier 4. The exhaust tube 7 is integrated with a stem element 8 having a larger diameter than the exhaust tube 7.

The stem element 8 and the exhaust tube 7 are typically made of glass. A portion of the exhaust tube 7 is inside the stem element 8 and another portion of the exhaust tube 7 is outside the stem element 8, the outside portion 7' having an open end 7" and supporting the carrier 4 via the fastener 6. The stem element 8 has a proximal portion 8', which is proximal to the connector 2, and a distal portion 8" which is distal to the connector 2. The proximal portion 8' is sealed to the connector 2. The outside portion 7' of the exhaust tube 7 extends from the distal portion 8" along the optical axis OA.

Contact wires 9 are fixed to the stem element 8. It may be noted that the assembly consisting of the stem element 8, the exhaust tube 7 and the contact wires 9 is sometimes referred to as the "stem" of a light bulb. The contact wires 9 protrude from the stem element 8 and electrically connect the carrier 4 to a driver 10 for powering the light sources 5. The driver 10 is in this example arranged inside the connector 2 but may in other examples be arranged completely inside the envelope 3, supported by for example the carrier 4 or the fastener 6. An isolation part 11, which electrically isolates some parts of the driver 10 from the connector 2, may be arranged between the driver 10 and the connector 2.

A wireless communication antenna 12 (henceforth referred to as the "antenna" for brevity) is arranged inside the exhaust tube 7 so as to be galvanically isolated from carrier 4. The antenna 12 in this example is a straight monopole antenna. The length of the antenna 12 is usually approximately equal to □/4, where □ is the wavelength of a signal that the antenna 12 is configured to receive. A typical antenna length is about 3 cm. A control circuit 13 is electrically connected to the antenna 12 and the circuit board on which the light sources 5 are mounted. The control circuit 13 is configured to control the light sources 5 and usually comprises a microcontroller and a radio frequency receiver. The control circuit 13 is in this example integrated with the driver 10, but may be a separate unit in other examples. The control circuit 13 may be powered by the driver 10.

Figure 2:
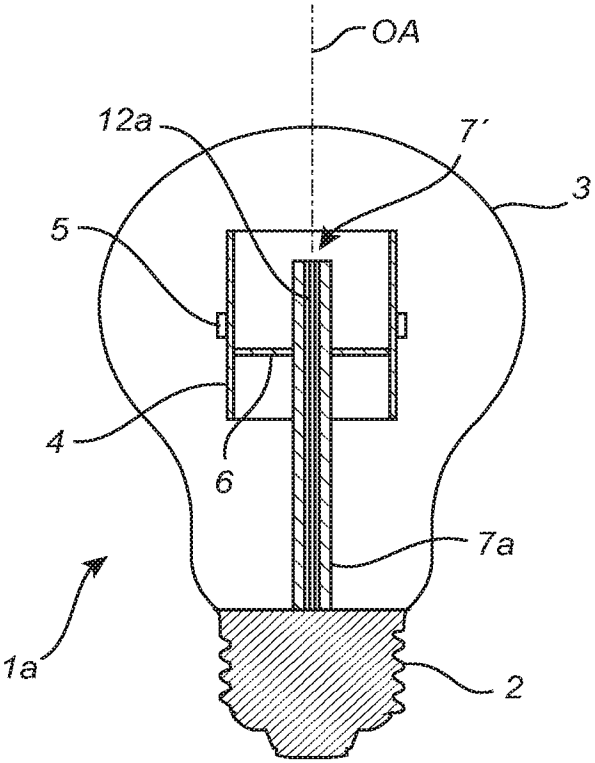

FIG. 2 shows an example of a lighting device 1*a* which is similar to the one in FIG. 1. The antenna 12*a* extends up to the open end 7' without sticking out from the exhaust tube 7*a*. The open end 7' is situated inside the carrier 4.

Figure 3:
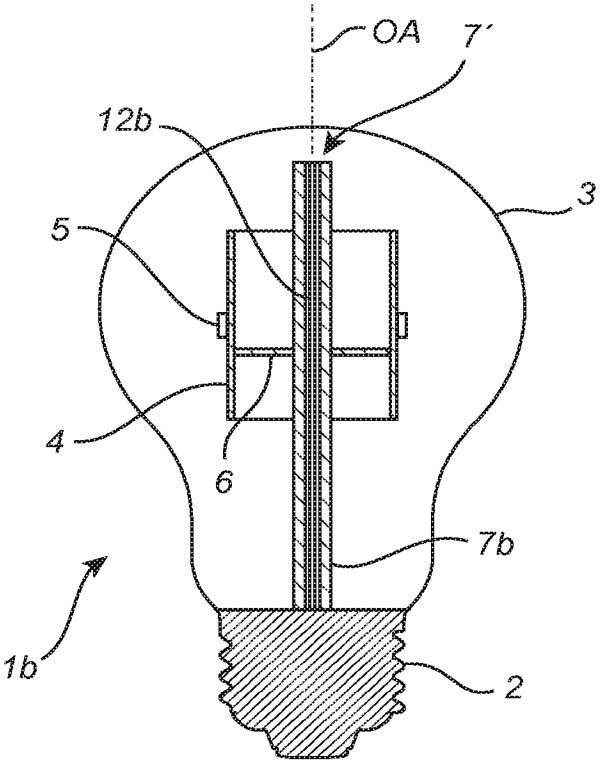
FIGS. 2-8 show schematic cross sectional views of further examples of lighting devices.

FIG. 3 shows a lighting device 1*b* which is similar to the one in FIG. 1*a* except that the exhaust tube 7*b* extends all the way through the interior space of the carrier 4 so that the open end 7' is situated outside the carrier 4 (more precisely above it).

Figure 4:
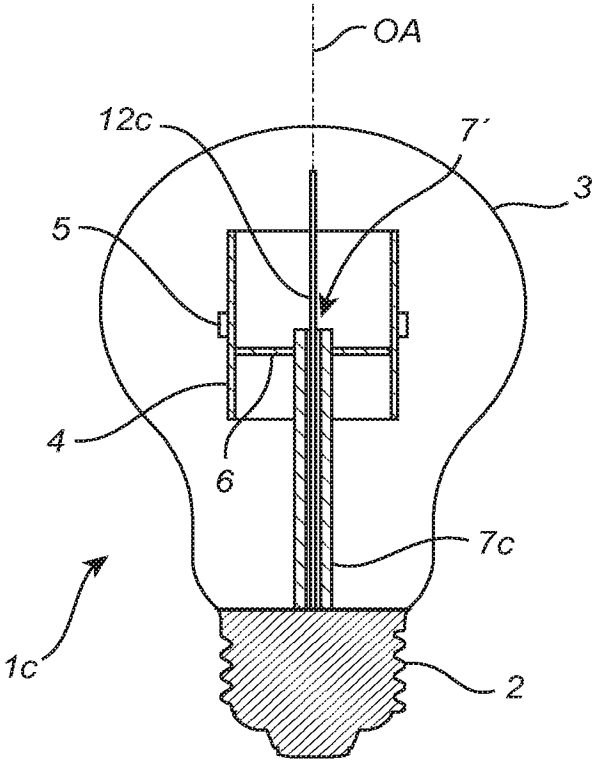

FIG. 4 shows a lighting device 1*c* which is similar to the one in FIG. 1 except that a portion of the antenna 12*c* protrudes from the open end 7' of the exhaust tube 7*c*. In the illustrated example, the open end 7' is inside the carrier 4 and the outer portion of the antenna 12*c* extends straight up to the outside of the carrier 4. Of course, the outer portion of the antenna 12*c* may in another example be shorter so that it is still completely inside the carrier 4.

Figure 5:
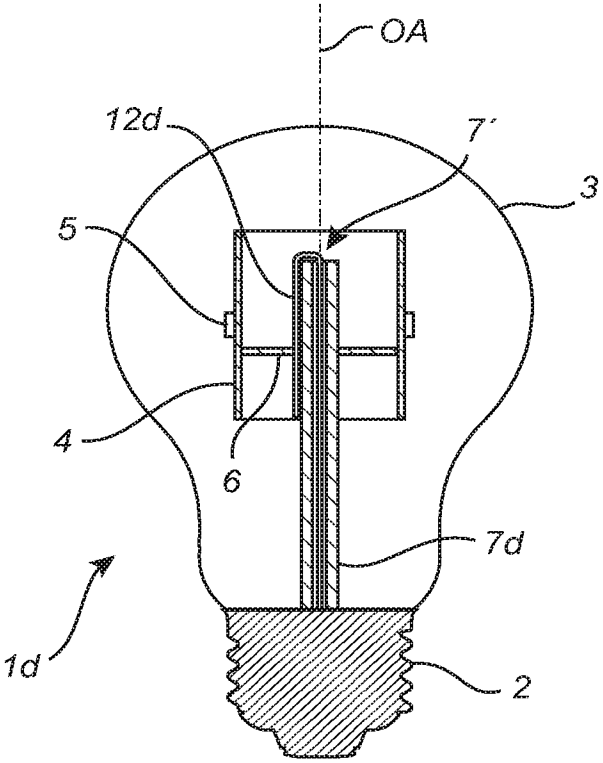

FIG. 5 shows a lighting device 1*d* which is similar to the one in FIG. 4 except that the outer portion of the antenna 12*d* has been bent downwards so as to extend straight along the outer surface of exhaust tube 7*d*.

Figure 6:
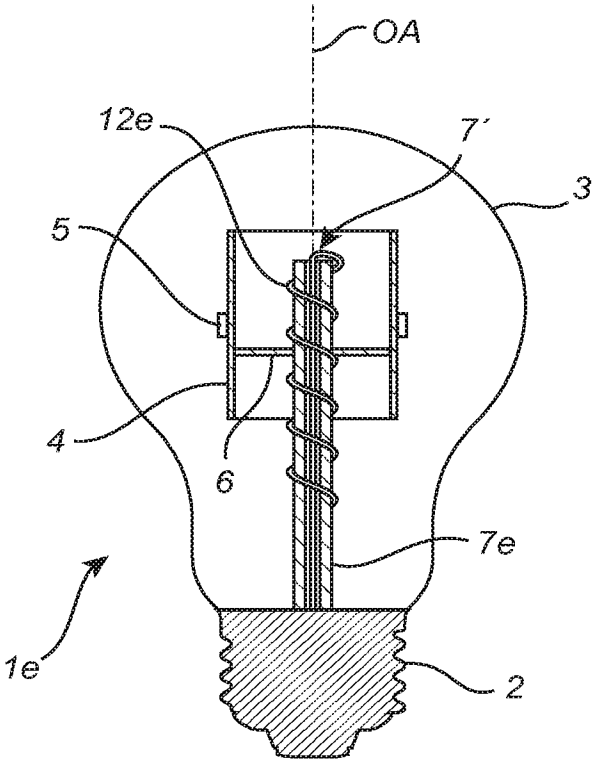

FIG. 6 shows a lighting device 1*e* which is similar to the lighting device in FIG. 5 except that the outer portion of the antenna 12*e* is wound around the exhaust tube 7 so as to form a coil.

Figure 7:
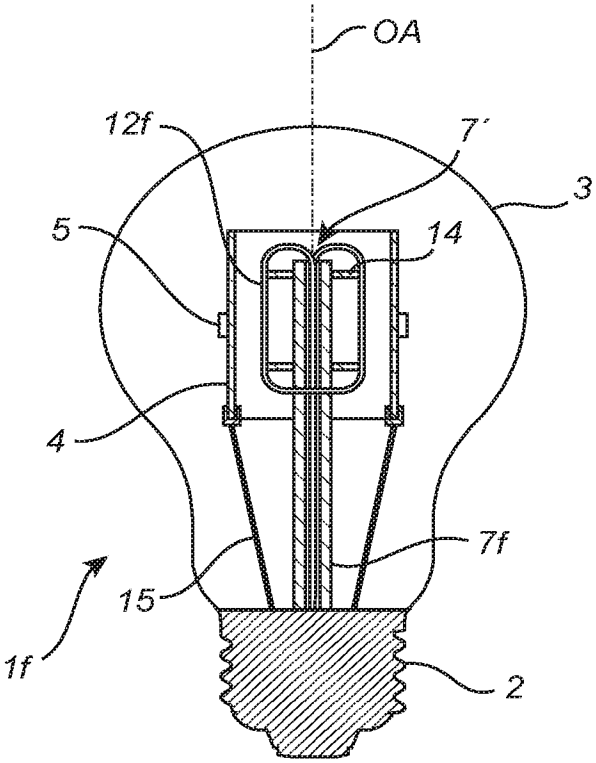

FIG. 7 shows a lighting device if having a support structure 14 which is attached to the exhaust tube 7*f* and which supports the outer portion of the antenna 12*f* at a distance from the exhaust tube 7*f* The outer portion of the antenna 12*f* has in this example a loop-like shape. Furthermore, the carrier 4 is attached to the exhaust tube 7*f* via a carrier support 15 that extends upwards from the connector 2 and that holds the carrier 4 in place inside the envelope 3.

Figure 8:
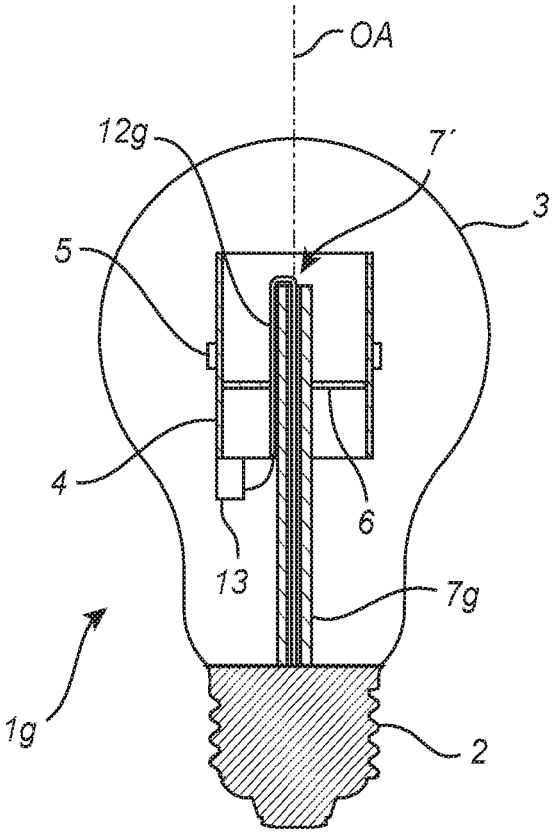

FIG. 8 shows a lighting device 1*g* in which the control circuit 13 is located completely inside the envelope 3. The control circuit 13 is attached to and supported by the light source carrier 4. The outer portion of the antenna 12*g* is electrically connected to the control circuit 13.

Figure 9:
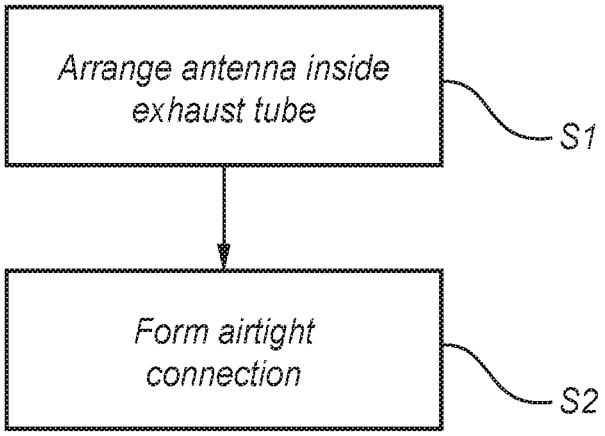
FIG. 9 shows a flowchart of some of the steps of a method for producing a lighting device.

FIG. 9 shows a flowchart of some of the steps of a method for producing a lighting device, such as a gas filled light bulb. The method includes a step S1 in which an antenna 12 is arranged inside a glass exhaust tube 7. The exhaust tube 7, with the antenna 12 inside, is put in a holder suitable for a glass melting and fusion process together with a glass stem element 8 and contact wires 9. The distal portion 8" of the stem element 8 is heated up to a temperature where the glass becomes viscous, and the exhaust tube 7 is indirectly heated to the same temperature. The hot glass is pressed so that an airtight connection is formed between the stem element 8 and the exhaust tube 7 and also between the stem element 8 and the contact wires 9. The pressing of the glass creates what is usually referred to as a "pinch" on the stem element 8. The glass is then allowed to cool down somewhat, after which a small area of the pinch between the contact wires 9 is heated up again and a small hole is made through the pinch by introducing pressurized air into the exhaust tube 7. The hole makes it possible to connect the exhaust tube 7 to the inside of the light bulb once the stem 8 is sealed to the envelope 3. The light source carrier 4 with the solid state light sources 5 is then mounted on the exhaust tube 7 and electrically connected to the contact wires 9, for example by welding. The whole assembly is positioned inside a glass envelope 3 which is sealed to the proximal portion 8' of the stem element 8 by heating the glass from the outside while the stem and envelope assembly is rotated. Next the light bulb is flushed, filled and closed in a process that is sometimes referred to as "pumping and tipping". The inside of the envelope 3 is cleaned by repeated flushing with an inert gas, wherein a special type of valve is used to control the gas flow through the exhaust tube 7. A filling gas is pumped into the cleaned envelope 3 through the exhaust tube 3 by means of a filling system. Next, in step S2, an airtight connection between the antenna 12 and the exhaust tube 7 is formed so that the filling gas cannot escape from the envelope 3 through the exhaust tube 7. This may be done by heating the exhaust tube 7, between the envelope 3 and the valve, and pressing the heated exhaust tube 7 against the antenna 12. A portion of the exhaust tube 7 that is outside the envelope 3 is then removed, for instance by "scoring and breaking" the exhaust tube 7. This involves creating a weak spot that makes it possible to break the exhaust tube 7 at a precise point. The weak spot can for example be created by scratching the exhaust tube 7 with a diamond knife or by locally reducing the diameter of the exhaust tube 7 through heating and pressing. A portion of the antenna 12 usually sticks out from the tip where the exhaust tube 7 was broken off. If the antenna 12 is mounted upside down, however, it may be possible to break the exhaust tube 7 at a point such that the antenna 12 does not stick out from the exhaust tube 7 afterwards. Finally, a connector 2 is attached to the envelope 3, and the electronics inside the connector 2 is connected to the contact wires 9 and the antenna 12, for example by electric welding or soldering or by means of piercing connectors or poke-in connectors.

The lighting device is put in operation by plugging the connector 2 into an electrical socket connected to an electricity supply, whereby the driver 10 supplies power to the light sources 5 via the contact wires 9 and the carrier 4. The light sources 5 emit light that is transmitted through the envelope 3. A mobile device such as a smartphone may be used to control the light sources 5 by sending radiofrequency signals to the antenna 12. The signals received by the antenna 12 are processed by the control circuit 13 which controls the light sources 5. Depending on the application, it may be possible to for example turn the light sources on and off, to dim the light sources and to change the color settings of the lighting device.

The person skilled in the art realizes that the present invention by no means is limited to the preferred embodiments described above. On the contrary, many modifications and variations are possible within the scope of the appended claims. For example, the shape of the envelope 3 is not limited to a pear-like shape. Some examples of other envelope shapes include cylindrical, ellipsoidal and conical. Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lighting device comprising:

a light source carrier having one or more solid state light sources, the light source carrier being a heat sink for the one or more solid state light sources;

a light transmissive envelope to contain the light source carrier;

a connector for mechanically and electrically connecting the lighting device to a lamp socket;

an exhaust tube being arranged inside the light transmissive envelope for introducing a gas into the light transmissive envelope during production and then being sealed to keep the light transmissive envelope airtight, wherein at least a portion of the exhaust tube is surrounded by the light source carrier such that the exhaust tube is partly arranged in an interior space of the light source carrier;

a wireless communication antenna arranged inside the exhaust tube, wherein the antenna is galvanically isolated from the light source carrier, further wherein an outer portion of the wireless communication antenna protrudes from an open top end of the exhaust tube;

a support structure attached to the exhaust tube, wherein the support structure is configured to support the outer portion of the wireless communication antenna at a first distance from the exhaust tube and a second distance from the light source carrier; and a control circuit electrically connected to the wireless communication antenna and configured to control the one or more solid state light sources.

2. The lighting device according to claim 1, wherein:

the light source carrier includes a tubular light source carrier attached to the exhaust tube, the exhaust tube being arranged partly inside the tubular light source carrier.

3. The lighting device according to claim 2, wherein an open end of the exhaust tube is situated inside the tubular light source carrier.

4. The lighting device according to claim 2, wherein the tubular light source carrier is adapted to act as a radiator, an electrical resonance frequency of the tubular light source carrier being approximately equal to a receiving frequency of the antenna.

5. The lighting device according to claim 2, further comprising: a driver configured to power the one or more solid state light sources.

6. The lighting device according to claim 5, wherein the control circuit is positioned completely inside the envelope.

7. The lighting device according to claim 5, further comprising at least one of a light scattering layer and a wavelength converting layer.

8. The lighting device according to claim 5, wherein the lighting device is a gas filled light bulb.

9. The lighting device according to claim 1, wherein the outer portion of the antenna has a loop-like shape.

10. The lighting device according to claim 1, wherein the light source carrier is attached to the exhaust tube via a carrier support, wherein the carrier support extends upwards from the connector.

11. A method for producing a lighting device, comprising arranging an antenna inside an exhaust tube of the lighting device;

forming an airtight connection between the exhaust tube and a stem element;

sealing the stem element together with the exhaust tube and the antenna in a light-transmissive envelope;

connecting a connector containing a control circuit with the envelope and the stem element via contact wires such that the control circuit is electrically connected to the antenna; and mounting a light source carrier with solid state light sources on the exhaust tube, wherein the antenna arranged in the exhaust tube is galvanically isolated from the light source carrier, wherein an outer portion of the antenna protrudes from an open top end of the exhaust tube, wherein a support structure is configured to support the outer portion of the antenna at a first distance from the exhaust tube and a second distance from the light source carrier, and wherein the light source carrier surrounds at least a portion of the exhaust tube such that the exhaust tube is partly arranged in an interior space of the light source carrier.

12. The method according to claim 11, further comprising filling an inert gas in the light-transmissive envelope through the exhaust tube such that the gas-filled light-transmissive envelope protects one or more solid state light sources of the lighting device inside the light-transmissive envelope.

* * * * *